US008342811B2

(12) United States Patent
Berwanger

(10) Patent No.: US 8,342,811 B2
(45) Date of Patent: Jan. 1, 2013

(54) SENSOR ASSEMBLY, A FLUID PUMP AND A COOLER

(75) Inventor: Egidio Berwanger, Joinville (BR)

(73) Assignee: Whirlpool S.A., Sao Paulo (BR)

( * ) Notice: Subject to any disclaimer, the term of this patent is extended or adjusted under 35 U.S.C. 154(b) by 1473 days.

(21) Appl. No.: 10/557,538

(22) PCT Filed: May 18, 2004

(86) PCT No.: PCT/BR2004/000068

§ 371 (c)(1),
(2), (4) Date: Dec. 22, 2006

(87) PCT Pub. No.: WO2004/104419

PCT Pub. Date: Dec. 2, 2004

(65) Prior Publication Data

US 2007/0177984 A1 Aug. 2, 2007

(30) Foreign Application Priority Data

May 22, 2003 (BR) ..... 0301969

(51) Int. Cl.
*F04B 49/06* (2006.01)

(52) U.S. Cl. ..... 417/44.11; 417/44.1; 73/514.34

(58) Field of Classification Search ..... 417/44.1, 417/63, 902, 44.11, 415–417; 73/1.28, 1.84, 73/514.34

See application file for complete search history.

(56) References Cited

U.S. PATENT DOCUMENTS 3,766,747 A 10/1973 Parker
4,586,377 A * 5/1986 Schmid ..... 73/514.34
4,620,446 A * 11/1986 Jensen et al. ..... 73/652
4,816,713 A * 3/1989 Change, Jr. ..... 310/319

(Continued)

FOREIGN PATENT DOCUMENTS

DE 100 51 752 5/2002

(Continued)

OTHER PUBLICATIONS

WO 02/33260, Abstract, http://v3.espacenet.com/publicationDetails/description?CC=WO&NR=0233260A1&KC=A1&FT=D&date=20020425&DB=EPODOC&locale=en_EP, Jun. 8, 2010.*

(Continued)

*Primary Examiner* — Peter J Bertheaud
(74) *Attorney, Agent, or Firm* — Alston & Bird LLP

(57) ABSTRACT

A sensor assembly for measuring movements of a fluid pump driven by an electric motor, the electric motor connectable to a feed voltage, the sensor assembly comprising an accelerometer electrically connected to a bias circuit, the latter comprising a feed terminal electrically connectable to the feed voltage of the motor and a signal terminal electrically connectable to an external measuring terminal. A fluid pump is also described, comprising a cylinder, a piston, a housing comprising a hermetic terminal and hermetically enclosing the cylinder and the piston, thus forming a hermetic assembly, the piston driven by an electric motor, the electric motor connected to an electric voltage by a pair of voltage terminals associated to the hermetic terminal, the fluid pump comprising a sensor assembly associated to the cylinder comprising a feed terminal connected to one of the voltage terminals and a signal terminal electrically connected to an external measuring circuit.

18 Claims, 5 Drawing Sheets

U.S. PATENT DOCUMENTS

| | | | | | |
|---|---|---|---|---|---|
| 4,835,436 | A | * | 5/1989 | Lew | 310/338 |
| 4,984,973 | A | * | 1/1991 | Itameri-Kinter et al. | 417/422 |
| 5,052,226 | A | * | 10/1991 | Schmid | 73/514.34 |
| 5,117,696 | A | * | 6/1992 | Schmid | 73/514.34 |
| 5,179,857 | A | * | 1/1993 | Sonderegger et al. | 73/114.07 |
| 5,846,056 | A | | 12/1998 | Dhindsa et al. | |
| 5,975,854 | A | * | 11/1999 | Culp et al. | 417/18 |
| 6,550,260 | B1 | * | 4/2003 | Sullivan | 62/126 |
| 6,655,211 | B1 | * | 12/2003 | Schmid et al. | 73/514.34 |
| 6,902,378 | B2 | * | 6/2005 | Gaudet et al. | 417/27 |
| 2003/0118460 | A1 | * | 6/2003 | Lilie et al. | 417/415 |
| 2004/0213677 | A1 | * | 10/2004 | Matzner et al. | 417/63 |

FOREIGN PATENT DOCUMENTS

| | | | |
|---|---|---|---|
| EP | 0 353 520 | | 2/1990 |
| EP | 1 143 146 | | 10/2001 |
| WO | WO 02/33260 | * | 4/2002 |

OTHER PUBLICATIONS

WO 02/33260, Unofficial Translation, http://epo.worldlingo.com/wl/epo/epo.html?ACTION=description-retrieval&COUNTRY=WO&FORMAT=docdb&KIND=A1&LOCALE=en_EP&NUMBER=0233260&OPS=ops.epo.org, Jun. 8, 2010.*

International Search Report for PCT/BR2004/000068 completed Sep. 17, 2004.

International Preliminary Report on Patentability for PCT/BR2004/000068 completed Jul. 26, 2005.

Written Opinion of the International Searching Authority for PCT/BR2004/000068.

* cited by examiner

SENSOR ASSEMBLY, A FLUID PUMP AND A COOLER

The present invention relates to a sensor assembly, provided with an accelerometer and used in detecting the positioning of a fluid-pump piston, to a fluid pump provided with this assembly, and to a cooler comprising a sensor assembly according to the teachings of the present invention.

DESCRIPTION OF THE PRIOR ART

A linear compressor (or fluid pump) is provided with a piston that is axially displaceable in an empty body, usually a cylinder, this piston being responsible for compressing the gas used in the cooling cycle. At the end of the piston stroke, close to a head, valves are provided, which regulate the entry and exit of the gas into/out of the cylinder, these valves being a suction valve and a discharge valve, respectively.

Usually, the cylinder rests on a spring that maintains it suspended so as to prevent the trepidation caused by the axial movement of the piston from being transferred to the equipment where the fluid pump is employed.

Since the conditions of operation of the fluid pump may vary because of alterations in the fluid charge being pumped, or even variations in the feed voltage, the piston may be displaced beyond an acceptable limit as far as a point where it might collide with the cylinder head, so that it is recommendable to control its movement.

The fluid pump may further suffer external interferences by influence of mechanical impacts. This problem is particularly perceptible in linear compressors where the cylinder-piston assembly remains suspended by a spring, as described above. With this configuration, in the event of unexpected movement of the apparatus on which the fluid pump is installed (for example, a household refrigerator that suffer impacts) or even earthquakes, the assembly formed by piston and cylinder might get into a situation in which the latter oscillation, in association with said spring, fails to move axially, whereby a substantially pendular movement, whereby these pieces of equipment collide with the compartment where they are usually housed, which might lead to destruction thereof.

A number of solutions have been proposed to solve the above-cited problems, such as the use of inductive sensors, but these solutions have drawbacks, as for instance, it is difficult to install them and to modify the cylinder housing for placing said sensor.

Moreover, the solutions foreseen before do not approach the problem of interference in the stability of movement of the piston-cylinder assembly in the event of an external impact.

Another problem that results from the use of sensors according to prior techniques is the fact that these sensors require the use of additional electric connections, which, in the case of a compressor of a cooling system, may lead to loss of fluid-tightness of the respective housing, since it becomes necessary to open passageways on said housing for electric connections in addition to those usually foreseen in these cases, where a single hermetic terminal is employed.

It is known that the manufacture of hermetic terminals is particularly complicated, since such a piece should guarantee good electric connection and, at the same time, impart fluid-tightness to the pump. For this reason, it is particularly advantageous for the fluid pump not to need other passageways in its housing, in addition to that already foreseen by the hermetic terminal.

OBJECTIVES OF THE INVENTION

According to the teachings of the present invention, a sensor assembly for detecting movements of the piston and, thereby to prevent the problems of impacts by interferences resulting from variations in the fluid charge being pumped is provided, variations in the feed voltage, or event variations by influence of external impacts.

Other objectives of the present invention are a sensor assembly and a fluid pump, as well as a cooler provided with such elements, wherein the number of electric connections is minimized as much as possible, so that one can take advantage of the connectors that are normally used, thus avoiding the need to use additional connectors and taking advantage, for instance, of the connections in use on a hermetic terminal that is usually employed on cooling compressors.

BRIEF DESCRIPTION OF THE INVENTION

The objectives of the present invention are achieved by means of a sensor assembly, to measure the movements of a fluid pump, the fluid pump being actuated by an electric motor and the electric motor being connectable to a feed voltage, the sensor comprising an accelerometer that is electrically associated to a bias circuit, the accelerometer configuring first and second acceleration transducers, and comprising a feed terminal and a signal terminal, the feed terminal being electrically connectable to the motor feed voltage, and the signal terminal being electrically connectable to an external measuring circuit.

The objectives are also achieved by means of a fluid pump comprising a cylinder, a piston, a housing comprising a fluid-tight terminal hermetically enclosing the cylinder and the piston, thus forming a hermetic assembly, the piston being actuated by an electric motor, the electric motor being linked to an electric voltage by means of a pair of voltage terminals associated to the hermetic terminal, the fluid pump comprising a sensor assembly associated to the cylinder, the sensor assembly comprising a feed terminal and a signal terminal, the feed terminal being connectable to one of the voltage terminals and the signal terminal being electrically connectable to an external measuring circuit.

The objectives of the present invention are further achieved by means of a cooler having a sensor assembly that measures movements of the fluid pump, the fluid pump being actuated by an electric motor and the electric motor being connectable to a feed voltage, the sensor assembly comprising an accelerometer and wherein the accelerometer is electrically associated to a bias circuit, wherein the latter comprises a feed terminal and a signal terminal, the feed terminal being electrically connectable to the feed voltage of the motor, and the signal terminal being electrically connectable to the external measuring circuit.

BRIEF DESCRIPTION OF THE DRAWINGS

The present invention will now be described in greater detail with reference to an embodiment represented in the drawings. The figures show.

DETAILED DESCRIPTION OF THE FIGURES

Figure 1:
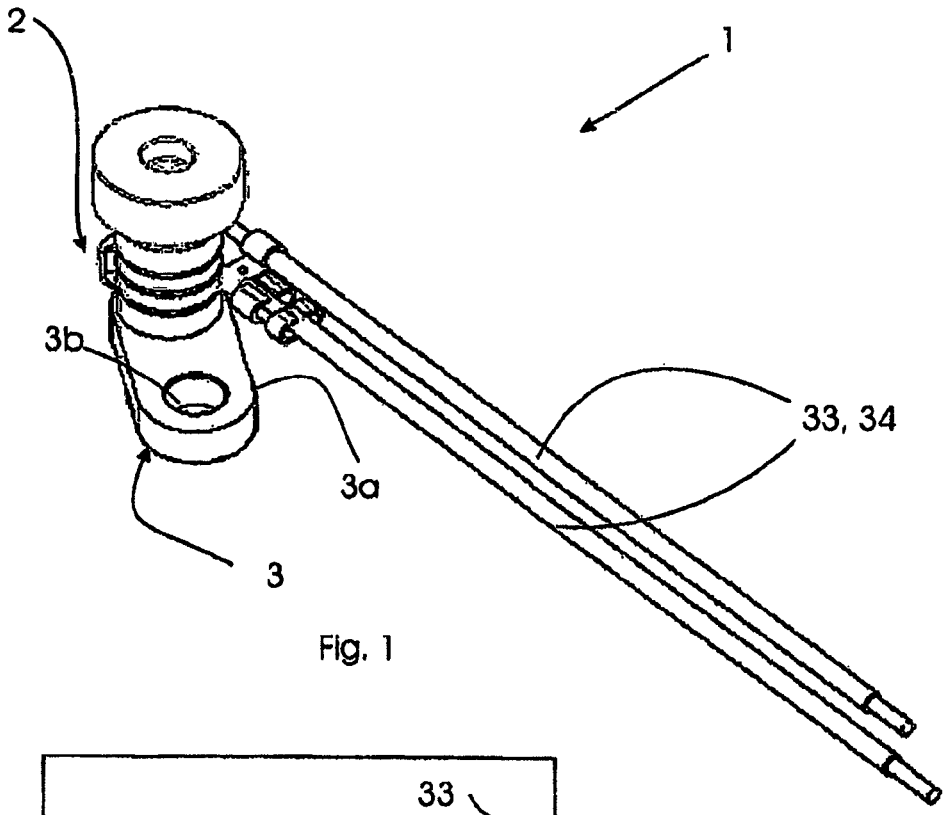
FIG. 1 is a perspective view of a sensor assembly comprising an accelerometer according to the teachings of the present invention.
Figure 2:
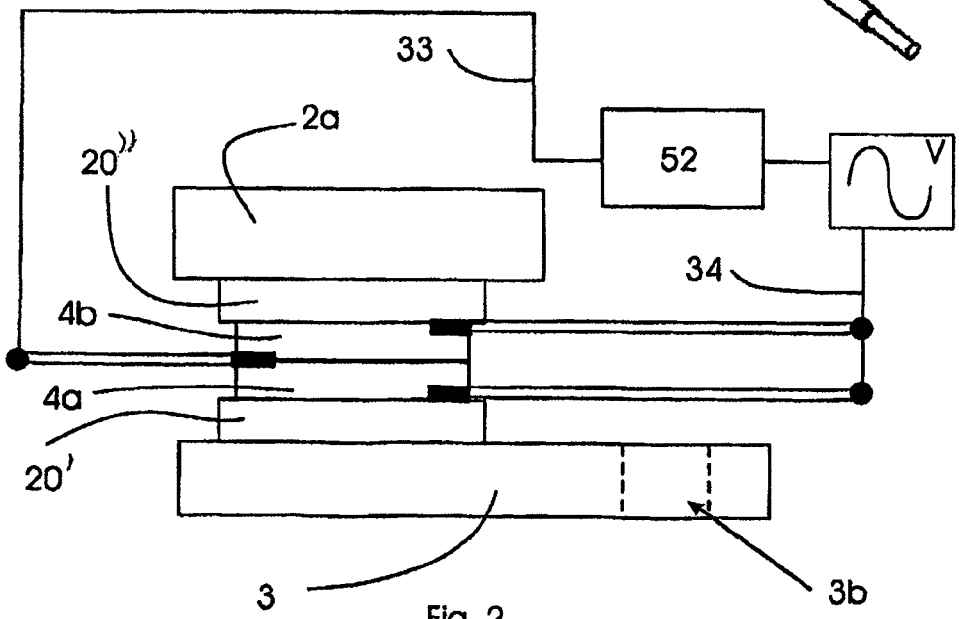
FIG. 2 is a schematic view of the sensor assembly comprising an accelerometer according to the teachings of the present invention.

As can be seen in FIGS. 1, 2, 3, 4, 5 and 6, according to the teachings of the present invention, a sensor assembly 1 is provided, which comprises an accelerometer 2 mounted on a support means 3.

The sensor assembly 1 is usually applied to a fluid pump 10 or a cooler compressor, these pieces of equipment being actuated by an electric motor 30 which, in turn, operates connected to a feed voltage V. The cooler can be a refrigerator, a freezer or any kind of apparatus equipped with a fluid pump.

Figure 3:
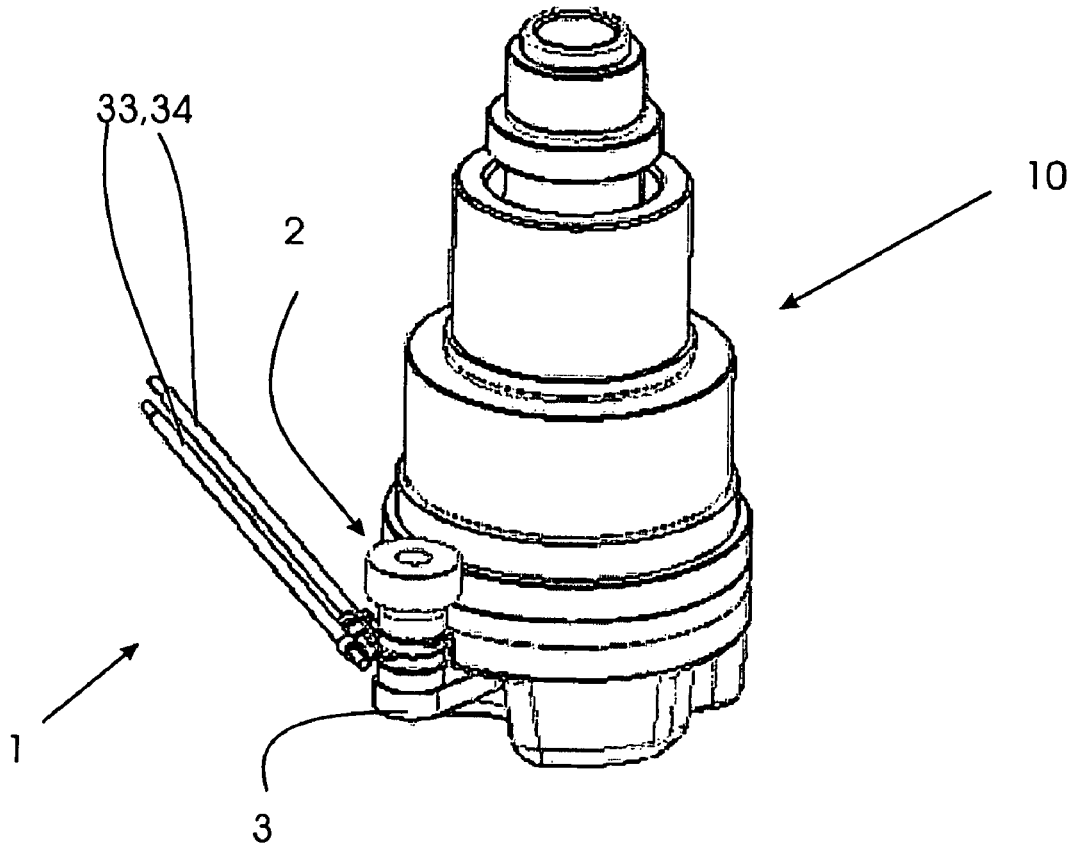
FIG. 3 is a perspective view of an embodiment of the fluid pump in the form of a compressor provided with a sensor assembly according to the teachings of the present invention.
Figure 4:
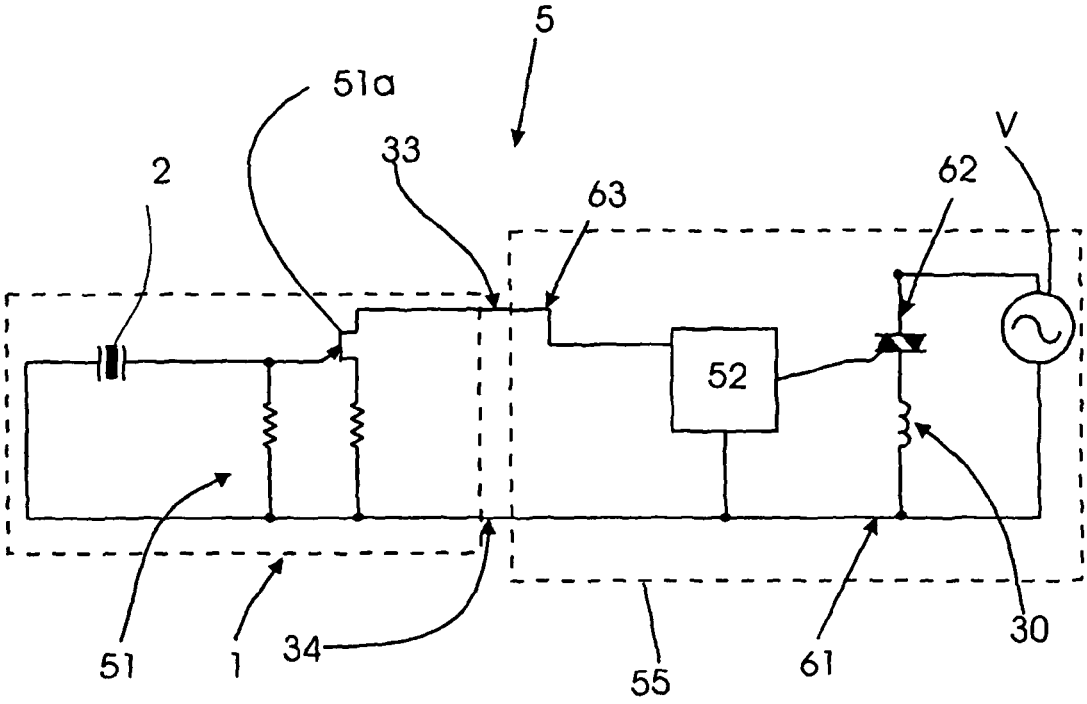
FIG. 4 is an example of en electronic circuit that controls the amplitude of the piston, as well as a form of mounting the sensor assembly according to the teachings of the present invention.

In particular with regard FIG. 3, one can see that the sensor assembly 1 comprises an accelerometer 2 electrically associated to a bias circuit 51.

The accelerometer 2 is composed of first and second acceleration transducers 4*a*, 4*b*, preferably piezoelectric crystals.

The accelerometer 2 has two terminals for connection to a measuring circuit 55, which will interpret the signals measured by means of the accelerometer 2, a feed terminal 34 for electric connection of the sensor assembly 1 directly to the feed voltage V of the motor 30, and a signal terminal 33 for the sensor assembly 1 electrically connected to the measuring circuit 55, and the latter may be provided separate from the sensor assembly 1, being usually positioned outside the fluid pump 10.

Moreover, the sensor assembly 1 further comprises at least the support means 3, on which the bias circuit 51 and the accelerometer 2 proper can be mounted. The support means 3, in turn, comprises a base portion 3*a*, usually a planar metallic plate with two ends, provided with at least one bore 3*b* to enable one to fix the sensor assembly 1 to the fluid pump 10 at one end and to mount the accelerometer 2 at the other free end. The support 3 should have high hardness in order to prevent interferences with the final signal of the accelerometer 2. In the event of the piston 57 suffering an impact at the end of the pump-cylinder 58 stroke, the support means 3 may not vibrate, since in this case the vibration of the support 3 itself generates an interference with the wave of the acceleration signal measured by the accelerometer 2.

A material that has the hardness required for the objectives of the present invention is steel, but one may foresee any other material that has the same functionalities.

In the example, shown in FIG. 3, one can see its convenient mount the sensor assembly 1 close to the fluid-pump head 10.

The sensor assembly 1 is mounted at the opposite end of the bore 3*b* of the support 3 and comprises, in its construction, a weight 2*a*, a first insulating element 20', a second insulating element 20", the accelerometer 2 and the terminals 33, 34 projecting from the accelerometers 2.

The weight 2*a*, preferably a seismic mass, is provided with a material having a high specific weight and high hardness, usually steel or any other material with the functional characteristics required for the invention, that is to say, the function of the weight 2*a* is to transfer the inertia of its mass to the accelerometer 2.

The first and second insulating elements 20', 20" should be made of a material having high hardness and provide electric insulation, preferably one should use washers made of porcelain. These properties are necessary for the accelerometer 2 to interpret only the vibrations of the assembly 1 arising from the pump 10.

As well as occurs with the support 3, should the weight 2*a* and the insulating elements 20', 20" do not have such properties (high specific weight and high hardness), the latter will vibrate and suffer deformations, and the accelerometer 2 will interpret these interferences as being part of the signal that will be sent to the electronic circuit 5, distorting it.

The signal terminal 33 and the feed terminal 34 are preferably provided with a rigid material, that is to say, rigid wires, so that the acceleration signal carried by them will not suffer interferences due to the vibrations to which they are subjected when an impact takes place between the piston 57 and the cylinder 58.

All the components of the sensor assembly 1 may have annular shape, thickness and size varying according to the need of the project, and the support 3 should have an adequate shape so that the sensor assembly 1 can be fixed to the fluid pump 10.

The constructive shape, as well as the functioning of the accelerometer will be explained later.

On the base surface 3*a*, more precisely at the free end of the support 3, one positions the first insulating element 20' and, on top of it, the first transducer 4*a* and, right afterwards, the second transducer 4*b*, which configure the accelerometer 2 and have the signal terminal 33 and the feed terminal 34 projecting from its body.

After positioning the two transducers 4*a*, 4*b*, one positions on top of the second transducer 4*b* the second insulating element 20", which has properties analogous to that of the first insulating element 20' and, finally, the weight 2*a* is placed on top of the assembly.

Since there is a proportionality of movement between the piston 57 and the cylinder 58, it is possible to control the stroke of the piston 57, for the sensor assembly 1, being fixed to the external part of the cylinder 58, causes interference with the accelerometer 2.

Preferably, in mounting the sensor assembly 1, one uses the insulating elements 20', 20" and the weight 2*a*, but one may use only the weight 2*a* and the support 3 or only the insulating elements 20', 20". In the possibility of using only the insulating elements 20', 20" and the weight 2*a*, the latter should have high hardness, as well as have the property of an electric insulant.

The functioning of the assembly is due to the monitoring of any abnormality of the movements of the piston 57 inside the cylinder 58. The abnormalities are, for example, collision of the piston 57 at the end of the stroke with the cylinder 58, bad functioning of the piston 57, stoppage of the piston, etc.

These abnormalities are sensed by the transducers 4*a*, 4*b*, which will send the obtained signal for interpretation by an external electronic circuit 55. Any interference in the acceleration of the piston 57 will be proportional to the acceleration itself of the sensor assembly 1.

The impact of the piston 57 with the cylinder causes vibrations on the pump 1, as well as on the sensor assembly 1, which senses this signal modified by compression of the accelerometer 2, and sends it to the electronic circuit 5.

Thus, as already described above, the assembly may not suffer interferences, since the latter will be interpreted as arising from abnormalities inside the cylinder 58.

In this embodiment, two acceleration transducers 4*a*, 4*b* are provided, but other mounting possibilities may be foreseen. The acceleration transducers 4*a*, 4*b* work in a compression-relief system, being either compressed when the piston 57 bumps at the end of the stroke with the cylinder or alleviated when the piston stops bumping.

For instance, one may foresee monitoring of the movements of the piston 57, which is uninterruptedly made when the piston 57 is moving. While, the piston 57 allows fluid to get into the cylinder 58, the acceleration transducers 4*a*, 4*b* remain compressed, and when the fluid is pressed out, the acceleration transducers 4*a*, 4*b* decompress, generating a standard compression-and-decompression signal. When the piston 57 pumps the cylinder 58, this signal will suffer interferences, which will be interpreted by the accelerometer 2 and the circuit 55, as shown in curves 21, 22.

The signals collected by the accelerometer 2 are transformed from physical magnitude (acceleration, increase or decrease in this magnitude) into electric signals and read by the electronic circuit 5, which comprise the bias circuit 51, located close to the sensor assembly 1 and an external measuring circuit 55. Preferably, the electronic circuit 5 should be positioned close to the sensor assembly 1, to have no wiring spacing between them that might cause interference in the acceleration signal obtained, that is, the parts should be mounted closely to each other. In this regard, it should be foreseen that the electronic components of the sensor assembly 1 should be structurally mounted close to each other, in order to prevent current charges from being drained by the respective wiring.

Figure 5:
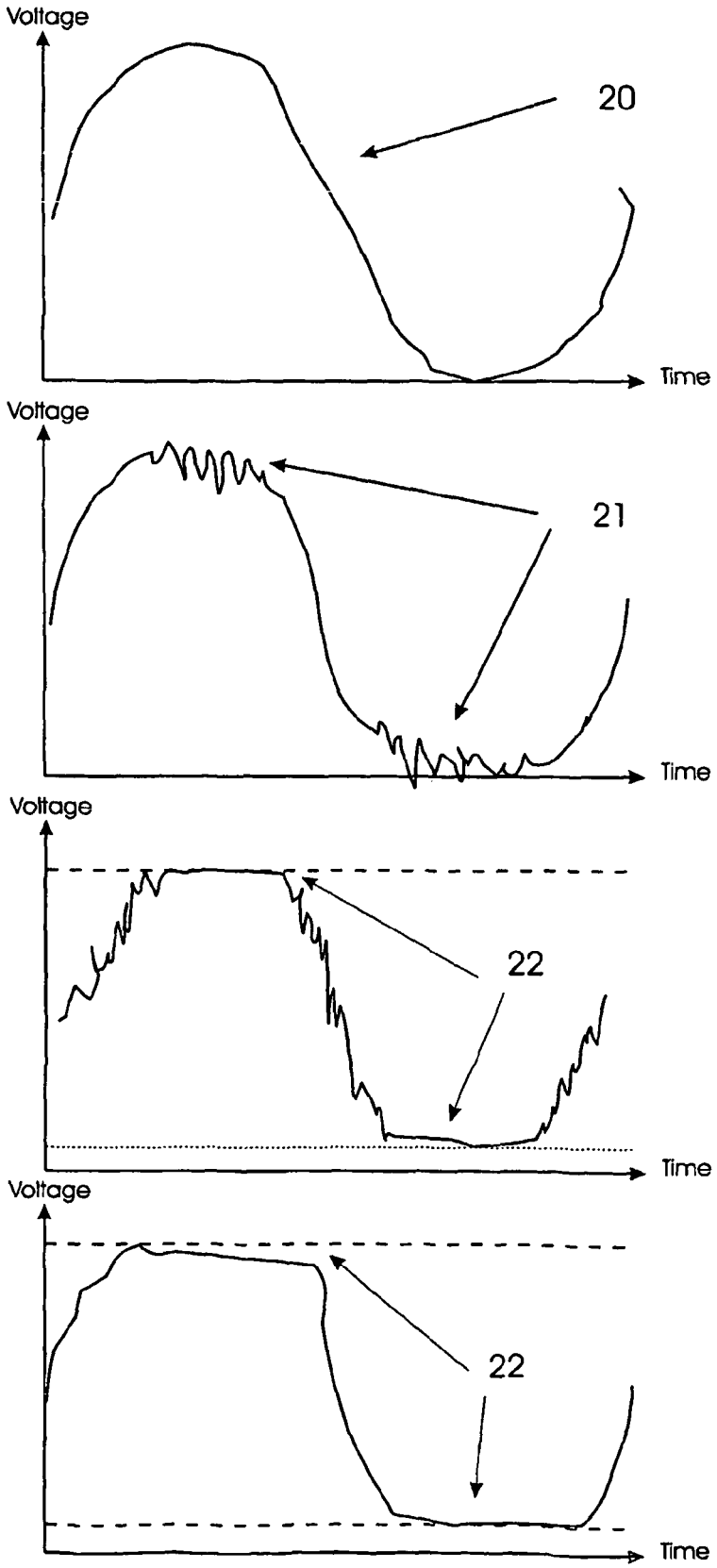
FIG. 5 shows examples of signals measured with a sensor assembly provided with an accelerometer according to the teachings of the present invention.

FIG. 5 illustrates some measurements carried out by means of a sensor assembly 1 according to the teachings of the present invention, wherein the measuring circuit 55 receives the signal from the accelerometer 2 through the bias circuit 51, which amplifies the magnitude. Specifically, the impedance of the signal from the accelerometer 2 is reduced by a transistor 51*a*, to send an electric signal of adequate amplitude and impedance, so that the external circuit 55 will receive the signal by means of the connection 54 and recognize it. The transistor 51*a*, for the sake of functionality, should be of the FET type, due to the high impedance of the circuit. In addition, with the use of a transistor 51*a* of this type, the sensor assembly 1 may serve various types of measuring circuit, since it will have high capability to supply current. The transistor 51*a* is operatively associated to the signal terminal and feed terminal 33, 34.

As can be seen in FIG. 5, the signal measured by the sensor assembly 1 on a linear compressor in a cooling system will vary as illustrated in the respective graphs.

In a situation of ordinary operation, the signal will have a substantially clean variation, as can be seen in curve 20. The signal may be of any format, obtained by means of a control routine (not described herein because it is not the object of the present invention).

The curves 21 and 22 illustrate, respectively, the situation in which the piston 57 has suffered a slight impact at the end of the stroke of the cylinder 58 (see curve 21), and the situations where the compressor has been subjected to an external impact (see curve 22).

In order to correct the problems resulting from the deviations of the curve 21 to the normal functioning of the compressor, the control routine (not described) may perform this function.

Further in accordance with the teachings of the present invention, in the case of mounting the sensor assembly 1 on a fluid pump 10, this assembly will be used for measuring the movement of the piston 58, which moves axially inside the cylinder 58. These elements—piston 57 and cylinder 58—remain enclosed inside the housing 50, which has a hermetic terminal 60 for the respective electric connections, forming a hermetic assembly 100. Since the housing 50 should be hermetic throughout the useful life of the equipment, it is recommendable that all the electric connections that will pass through the wall of the housing 50 and invade the respective internal portion 50' are made through the hermetic terminal 60 itself, which is already foreseen in pieces of equipments found on the market. The sensor assembly 1 is preferably installed in the external region of the cylinder 58, but it may further be mounted at any other point of the internal portion 50' of the housing 50 of the fluid pump 10, or even out of the latter, thus making possible a rapid, safe, inexpensive and reliable installation, for both use and a possible maintenance service.

Thus, one avoids the risks of loss of fluid-tightness of the housing 50, besides obtaining the advantage of avoiding the provision of an additional passageway for the connections of the sensor assembly 1.

In this way, from the internal portion 50' of the housing 50 to the outside, only three connections will be made, namely:

two connections for feeding the motor 30 (or voltage terminals 61, 62); and only one connection to the signal terminal 33, which is electrically connectable to the external measuring circuit 55, comprising, for example, a microprocessor 52.

Figure 6:
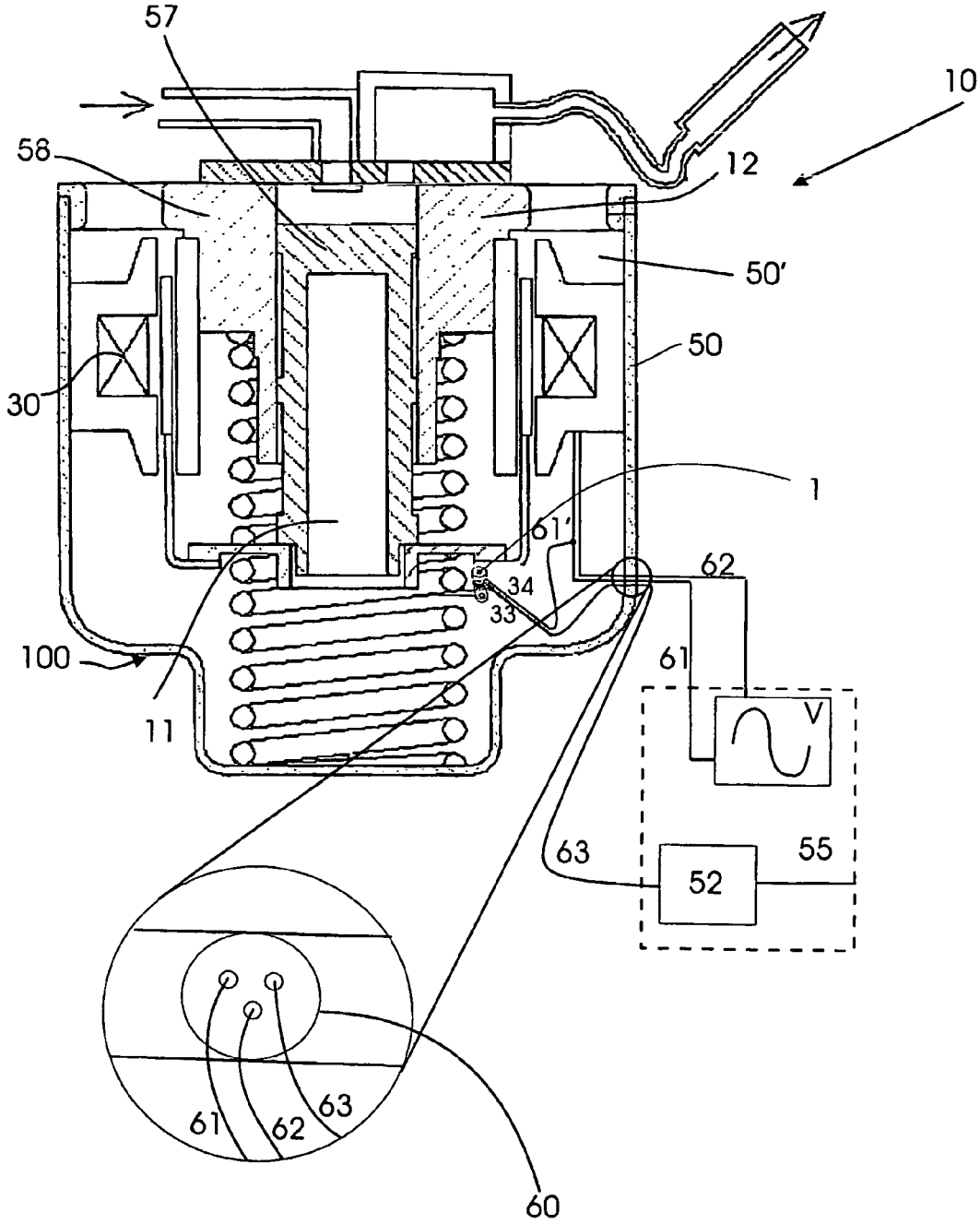
FIG. 6 illustrates a schematic example where a compressor is provided with a sensor assembly according to the teachings of the present invention.

FIG. 6, illustrates an example where a linear compressor having the signal terminal 33 directly connected to the measuring circuit 55, by means of a signal-passageway connection 63 passing through the hermetic terminal 60. The feed terminal 34 may be directly linked to one of the voltage terminal 61, 62 (see indication 61' in the example of FIG. 5), the latter being directly connected to the feed voltage V of the motor 30.

A preferred embodiment having been described, one should understand that the scope of the present invention embraces other possible variations, being limited only by the contents of the accompanying claims, which include the possible equivalents.

The invention claimed is:

1. A sensor assembly (1) for measuring movements of a fluid pump (10), the fluid pump (10) being located inside a hermetic housing (50) and being driven by an electric motor (30) and the electric motor (30) being connectable to a feed voltage (V), the sensor assembly (1) comprising an accelerometer (2), the accelerometer (2) being electrically connected to a bias circuit (51), the accelerometer (2) comprising first and second acceleration transducers (4*a*, 4*b*), a feed terminal (34), and a signal terminal (33), the feed terminal (34) being directly electrically connectable to the feed voltage (V) of the electric motor (30), the signal terminal (33) being electrically connectable to an external measuring circuit (55), the external measuring circuit (55) being located outside the hermetic housing (50), and the sensor assembly being mounted in an internal portion (50') of the hermetic housing (50) of the fluid pump (10).

2. A sensor assembly according to claim 1, characterized by comprising a weight (2*a*)connected to the first and second acceleration transducers (4*a*, 4*b*), the signal terminal (33) and the feed terminal (34) projecting from the first and second acceleration transducers (4*a*, 4*b*), and a first insulating element (20') and a second insulating element (20").

3. A sensor assembly according to claim 2, characterized by comprising at least one support means (3) for the accelerometer (2), the support means (3) comprising a base portion (3*a*), the base portion (3*a*) being fixedly connected to the fluid pump (10).

4. A sensor assembly according to claim 3, characterized in that the first insulating element (20') is positioned on the surface (3*a*) of the support means (3).

5. A sensor assembly according to claim 4, characterized in that the first and the second acceleration transducers (4*a*, 4*b*), the second insulating element (20") and the weight (2*a*)are positioned on the first insulating element (20').

6. A sensor assembly according to claim 5 wherein the bias circuit (51) connected to the accelerometer (2) is mounted in the internal portion (50') of the hermetic housing (50) and connected to the external measuring circuit (55).

7. A sensor assembly according to claim 6, characterized in that the bias circuit (51) comprises a transistor (51*a*) operatively connected to the signal terminal (33) and to the feed terminal (34).

8. A sensor assembly according to claim 7, characterized in that the external measuring circuit (55) comprises a microprocessor (52), the microprocessor (52) measuring the signal of the sensor assembly (1) by means of the signal terminal (33).

9. A cooler characterized by comprising a sensor assembly (1), as defined in claim 1.

10. A fluid pump (10) comprising:

a cylinder (58), a piston (57), and a hermetic housing (50) comprising a hermetic terminal (60) and hermetically enclosing the cylinder (58) and the piston (57), forming a hermetic assembly (100), the piston (57) being driven by an electric motor (30), the electric motor (30) being connected to an electric voltage (V) by means of a pair of voltage terminals (61, 62) associated to the hermetic terminal (60), the fluid pump (10) being characterized by comprising a sensor assembly (1) operably connected to the cylinder (58), the sensor assembly (1) comprising a feed terminal (34) and a signal terminal (33), the feed terminal (34) being directly connected to one of the voltage terminals (61, 62) and the signal terminal (33) being electrically connectable to an external measuring circuit (55), the external measuring circuit (55) being located outside the hermetic housing (50), the sensor assembly (1) comprising a bias circuit (51) operably connected to an accelerometer (2), the sensor assembly (1) being mounted in an internal portion (50') of the hermetic housing (50).

11. A fluid pump according to claim 10, characterized in that the sensor assembly (1) comprises the accelerometer (2) operably connected to a support means (3), the support means (3) being fixed to the hermetic assembly (100).

12. A fluid pump according to claim 11, characterized in that the sensor assembly (1) comprises a base portion (3*a*), the base portion (3*a*) being fixedly connected to the hermetic assembly (100).

13. A fluid pump according to claim 12, characterized in that the sensor assembly (1) comprises a weight (2*a*), connected to a first insulating element (20') and to a second insulating element (20"), first and second acceleration transducers (4*a*, 4*b*), the feed terminal (34) and the signal terminal (33) projecting from the first and second acceleration transducers (4*a*, 4*b*).

14. A fluid pump according to claim 13, characterized in that the first insulating element (20') is positioned on the surface (3*a*) of the support of the sensor assembly (1).

15. A fluid pump according to claim 14, characterized in that the first and second acceleration transducers (4*a*, 4*b*), the second insulating element (20") and the weight (2*a*) are positioned on the first insulating element (20').

16. A fluid pump according to claim 15, characterized in that the bias circuit (51) comprises a transistor (51*a*) operatively connected to the signal terminal (33) and to the feed terminal (34).

17. A fluid pump according to claim 16, characterized in that the external measuring circuit (55) comprises a microprocessor (52), the microprocessor (52) measuring the signal of the sensor assembly (1) by means of the signal terminal (33).

18. A fluid pump according to claim 17, characterized in that the hermetic housing (50) comprises the hermetic terminal (60) for passage of the feed terminal (34) and signal terminal (33).

* * * * *